United States Patent [19]

Berner

[11] Patent Number: 4,542,782

[45] Date of Patent: Sep. 24, 1985

[54] ROTARY-TYPE HEAT EXCHANGER

[76] Inventor: Erling Berner, Loretohohe 5, 6300 Zug, Switzerland

[21] Appl. No.: 583,430

[22] Filed: Feb. 24, 1984

[30] Foreign Application Priority Data

Feb. 28, 1983 [JP] Japan ..... 58-30853

[51] Int. Cl.[4] ..... F28D 19/00

[52] U.S. Cl. ..... 165/9; 165/7; 165/8

[58] Field of Search ..... 165/9, 7, 8, 10

[56] References Cited

U.S. PATENT DOCUMENTS

| | | | |
|---|---|---|---|
| 2,942,857 | 6/1960 | Lyle et al. | 165/9 |
| 3,108,632 | 10/1963 | Jensen et al. | 165/9 |
| 3,773,105 | 11/1973 | Kondo | 165/9 |
| 4,056,141 | 11/1977 | Sakaki | 165/9 |
| 4,188,993 | 2/1980 | Heyn et al. | 165/9 |
| 4,256,171 | 3/1981 | Zeek | 165/7 |
| 4,306,611 | 12/1981 | Wardale | 165/7 |
| 4,316,500 | 2/1982 | Gentry et al. | 165/9 |

*Primary Examiner*—Albert W. Davis, Jr.

[57] ABSTRACT

A rotary-type heat exchanger comprises a rotor having gas passages in the direction of its shaft, a casing for said rotor, an entrance of said casing to guide the high temperature incoming gas to be used for the heat exchange exclusively toward said rotor except for the gas passages outer periphery thereof and the areas close to the shaft of said rotor, a heat insulation being treated on the inner wall of said entrance, a sealing member for high temperature being provided on the entrance toward said rotor to keep the gas leakage minimum, an exhaust gas outlet of said casing being provided on the side opposing to said entrance to guide all the exhaust gas passed through said rotor to outside, a sealing member being provided on the exhaust gas outlet toward said rotor of said exhaust gas outlet to keep the gas leakage minimum, an outer fresh gas inlet of said casing to guide outer fresh gas into said casing, for heat exchange and cooling an outlet port of said casing being provided on the side opposing to said outer fresh gas inlet to guide the heated gas from said rotor to outside, and a heat insulation being treated on the inner wall of said heated outer gas outlet port.

4 Claims, 3 Drawing Figures

ROTARY-TYPE HEAT EXCHANGER

BACKGROUND OF THE INVENTION

The present invention relates to an improvement for the insulation structure of a rotary-type heat exchanger, and more particularly for one suitable for rotary-type heat exchangers for high temperature.

Gas of temperatures as high as several hundreds to over 1,000° C. is exhausted from boilers, engines, incinerators, furnaces and various other devices. As the save-energy campaign has actively been promoted in recent years, those exhaust gas has attracted much attention as a potential source of energy. However, as those exhaust gas is often contaminated, it is necessary to heat-exchange it with clean gas such as the outer air so that the heated new gas is supplied to a boiler for combustion.

When a rotary-type heat exchanger is used for such a heat exchange process, the gas used is of a considerably high temperature, and therefore it should have a heat-resistant structure. This often causes following problems:

(1) When the gas used is 800° C. or higher, a casing which houses a rotor and which is generally made of stainless steel can not endure the high temperature. The casing must therefore be made of Mn steel or other heat-resistant special metals, brick of ceramics or must be provided with a special cooling device such as water-cooled fins. But those heat-resistant or insulated casings are expensive in material, manufacturing and installation costs, consequently pushing up the price of a rotary-type heat exchanger. This will thwart the save-energy campaign.

(2) The bearings which support the rotor, a driving mechanism therefor and sealing means for the gas must be made of heat-resistant materials. This further pushes up the cost.

The rotor made of ceramics and therefor having a good heat resistance can withstand temperatures of 1,000° C. or more is available.

As described in the foregoing, in prior art rotary-type heat exchangers for high temperature, various special parts must be used in order to give heat resistance to various locations other than the rotor. This unavoidably makes the cost quite expensive without leaving much economical gain from the recycling of the heat in the exhaust gas.

The present invention aims to obviate above mentioned defects encountered in prior art and to provide a rotary-type heat exchanger which is low in cost and excellent in heat resistance. Such object can be attained by limiting the area which is subjected to high temperatures. In other words, as the rotor in a rotary-type heat exchanger has gas passages in the direction of the shaft alone and has little heat transmission in the radial direction, the gas of high temperature to be used in the heat exchanger passes only through the rotor, and more particularly the areas of the rotor other than those in the vicinity of its shaft and outer periphery while the new low temperature gas with which the heat exchange is to be conducted is passed through all the areas of the rotor other than those where the high temperature gas is passed as well as through the voids between the rotor and the casing. This cools the casing, the rotor bearings and the driving mechanism with the gas of lower temperature and blocks them from the gas of high temperature without necessitating special parts made for special heat resistance. In short, special heat-resistance has to be provided only to the inner wall of the inlet for the hot gas, the sealing member for preventing leak of the gas and the inner wall of the outlet for the new hot gas which has been heat-exchanged and heated to a high temperature. The cost of component parts is thus remarkably reduced, the insulation work is simplified, and an inexpensive rotary-type heat exchanger for high temperature is attained.

SUMMARY OF THE INVENTION

It is an object of the present invention to provide a rotary-type heat exchanger which is low in cost and excellent in heat resistibility.

The object has been attained by the rotary-type heat exchanger which is characterized in that a rotor having gas passages in the direction of the shaft is provided in a casing, and said casing provided with an entrance to guide the gas of high temperature to be used for the heat exchange exclusively toward the rotor except for the gas passages close to the shaft and the outer periphery thereof, a sealing member for high temperature which is provided on said high temperature gas entrance end face of said rotor to keep the gas leakage to a minimum, an exhaust gas outlet which is provided on the side opposite to said entrance to guide all the exhaust gas which has been passed through the rotor for heat exchange to the outside, a sealing member which is provided on said exhaust gas outlet end face of said rotor to keep the gas leakage to a minimum, an outer gas inlet which guides outer gas into the casing, and an outlet port which is provided on the side opposite to said outer gas inlet to guide the gas which has been heated in the heat exchange to the outside and an inner wall of said heated outer gas outlet port which is treated to have heat resistance.

DESCRIPTION OF THE PREFERRED EMBODIMENT

Figure 1:
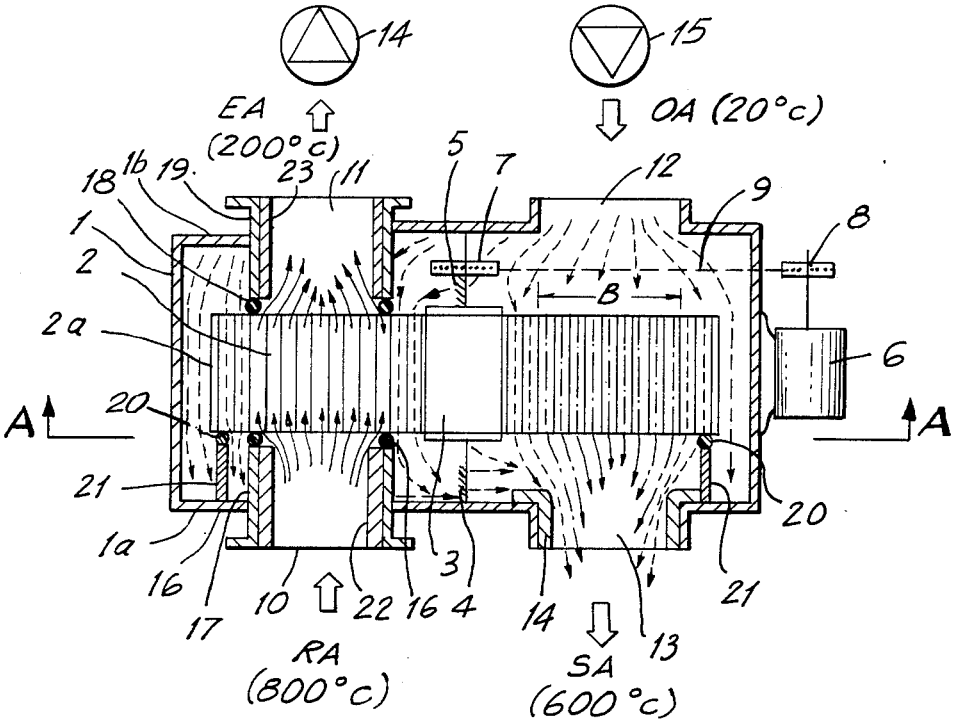
FIG. 1 is a sectional view of an embodiment of the rotary-type heat exchanger according to the present invention.
Figure 3:
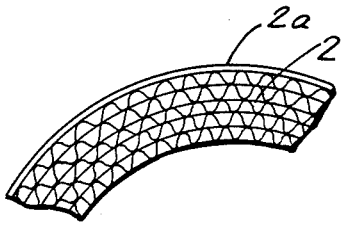
FIG. 3 is a frontal view of a part of the rotor.
Figure 2:
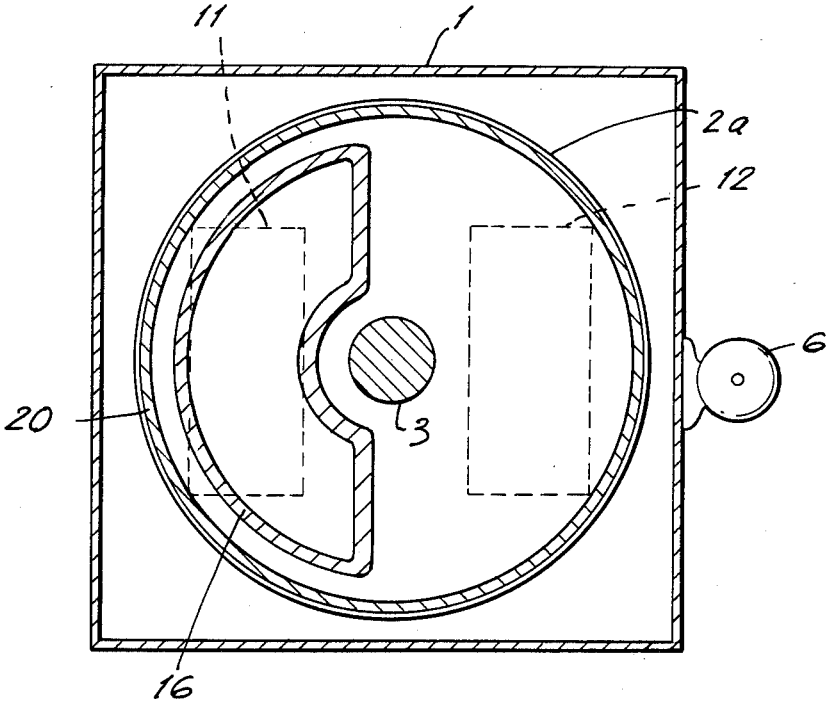
FIG. 2 is a sectional view to indicate the position of sealing means seen from the arrow A—A.

The present invention will now be described referring to the attached drawings. FIG. 1 is a sectional view to show an embodiment according to the present invention. FIG. 2 is a sectional view seen from the arrow A—A of FIG. 1 to indicate the position of the sealing member. FIG. 3 is a frontal view to show a part of a rotor.

In the drawings, the rotary-type heat exchanger according to the present invention uses the hot exhausted gas RA of about 800° C. which has returned from a boiler to heat the outer air OA to about 600° C., thereby obtaining the hot supply air SA for the boiler.

A casing 1 is a rectangular box made of conventional materials such as regular or stainless steel and a rotor 2 made of ceramics is housed within the casing 1. The rotor 2 has a honeycomb structure wherein corrugations are laminated as shown in FIG. 3 and has the gas passages only in the direction of the shaft. It, therefore, does not pass the gas in the direction of radius. The shaft 3 of the rotor 2 is supported by bearings 4, 5 and is slowly driven to rotate by a motor 6 provided on the outer side of the casing via sprockets 7, 8 and a chain 9. On the front 1*a* and the rear 1*b* of the casing 1 are provided rectangular openings 10, 11, 12, 13 in an opposing manner. The exhaust gas RA of around 800° C. returned from a furnace is put into the opening 10 on the front side 1*a* while the outgoing exhaust gas EA which has been cooled to around 200° C. is exhausted from the opening 11 on the rear side 1*b* which opposes the opening 10. The outer air OA of about 20° C. is put into the opening 12 on the rear side 1*b* while the supply air SA which has been heated to about 600° C. is supplied from the opening 13 on the front side 1*a* to a boiler, or a furnace.

The reference numerals 14, 15 denote air blowers for the exhaust gas EA and the air OA of low temperatures respectively. The air blower 14 sucks the exhaust gas EA from the rotor 2 while the air blower 15 feeds the outer air OA to the rotor 2.

The reference numeral 16 denotes a sealing member for high temperatures which is installed along the end of a duct 17 end face of the rotor which defines the inlet 10 for the hot exhaust gas RA. The sealing member 16 is installed semi-circularly to surround a half of the area on the end of the rotor 2 except for the areas in the vicinity of the shaft 3 and the outer periphery of the rotor 2 and to keep the gas leakage minimum. In other words, the section of the duct 17 for the hot exhaust gas RA changes its shape from a rectangle to a semicircle as it extends from outer side to the rotor.

The reference numeral 18 denotes a sealing member for high temperatures provided along the end of the duct 19 in face of the rotor which defines an outlet 11. The duct 19 for the outgoing exhaust EA has a shape identical to that of the duct 17 for the incoming hot exhaust gas RA. The sealing member 18 therefore has a shape identical to that of the sealing member 16 in order to keep the gas leakage minimum.

However, as the temperature of the outgoing exhaust gas EA is considerably lower than that of the incoming exhaust gas RA, the sealing member 18 is not required to have the heat resistance as high as that of the sealing member 16.

The reference numeral 20 denotes a sealing member for lower temperature having a substantially identical diameter to that of the rotor 2. The sealing member 20 is mounted on a ring 21 which is provided on the front inner surface of the casing 1 coaxially with the rotor 2 to surround the duct 17 for the exhaust gas and which has a diameter substantially identical to that of the rotor 2. The seal 20 will reduce the gas leakage as much as possible. The sealing member 20 is not always necessary, but, if provided, it helps to supply sufficient outer air passing through the outer periphery of the rotor 2, thereby improving the cooling effect therein. Above-mentioned each seal 16, 18, 20 may be non-contact type as labyrinth seal, or contact type.

The reference numerals 22, 23, 24 denote heat-resistant materials which form inner walls of the duct 17 for the high temperature exhaust gas RA, the duct 19 for the cooled down exhaust gas EA and the outlet 13 of the heated supply air SA. The heat-resistant materials may be ceramics, brick or a heat-resistant metal. The inner periphery wall 23 of the duct 19 for the cooled exhaust gas EA is not necessarily treated for heat-resistance as the exhaust gas EA has been fairly cooled. In this embodiment the duct 17, the duct 19 and the ring 21 are made of conventional materials such as regular or stainless steel.

The structure of a rotary-type heat exchanger has been described in the foregoing referring to embodiments. The operation thereof will now be explained.

When the hot exhaust gas RA enters the inlet 10, all of it passes through the semicircular area surrounded by the sealing member 16 into the rotor 2. The exhaust gas RA advances into the rotor 2 along the passage in the direction of the shaft, heats the rotor 2 and reaches the substantially semicircular area surrounded by the sealing means 18 to be exhausted from the outlet 11. The flow of the exhaust gas RA is indicated with an arrow in solid line in FIG. 1. Since the inlet area in the rotor 2 of the gas RA is firmly defined by the sealing member 16 and the duct 17, and since the rotor 2 is of a honeycomb structure made of heat-resistant materials which transmits very little heat in the radial direction, the portions of the rotor 2 in the vicinity of the shaft and outerperiphery of the rotor 2 are not very much heated by the hot exhaust gas RA, but the doughnut-like portion alone is heated. If the exhaust gas RA is assumed to be 800° C., the average temperature at the doughnut-like portion of the rotor 2 will be high enough to bring the temperature of the supply air OA to about 600° C. while that of the cooled down exhaust gas EA is about 200° C.

On the other hand, when the outer air OA enters the inlet 12, as indicated with an arrow in broken line in FIG. 1, it passes through the rotor 2 except for the portions sealed with the sealing member 18 for the exhaust gas EA and reaches all the corners and voids in the casing 1 so as to contact all the inner wall surfaces of the casing 1 and all the outer wall surface of the duct 19 for the exhaust gas EA. Some of the outer air OA, the main part of which enters the rotor 2 and is heated in heat exchanging part of the rotor 2, advances into the rotor 2 while cooling the heat exchaging material in the rotor. Some other part of the outer air OA is cooling the inner wall of the casing on the sides 1*a* and 1*b* thereof, the outer peripheral wall of the duct 19 for exhaust gas, the side of the sealing means 16 for high temperatures, the bearing 4 and the driving mechanism as well as the ring 21 and the seal 20.

The air entering the rotor 2, that which has passed through the area B heated by the exhaust gas RA or the one marked with an arrow mark in two-dot-chain alone is heated to, for instance, 600° C.

The air entering the rotor 2, that passing through the areas in the vicinity of the shaft 3 and the outer-periphery of the rotor 2 cools the areas and the bearing 5 which have not been heated to a high temperature. It advances from the rotor to the outlet port 13 to cool the bearing 4, the outer wall of duct 17 for the exhaust gas RA. The outer air rejected from the rotor 2 passes into the void between the casing 1 and the rotor 2 to cool the inner wall surface of the casing 1, the outside of the ring 21 and the outside of the sealing means 20 for low temperature as well as to act an insulation.

In short, high temperature gas contacts only with the rotor 2, the duct 17 for the incoming exhaust gas, the sealing means 16 and the outlet port 13 of the heated supply air SA. All the other parts other than the above are protected with the cool outer air OA and, even if heated somewhat the temperature thereof remains low. The heat resistant materials, therefore, are needed only for the duct 17 for the incoming hot exhaust gas, the sealing means 16 and 18, and the outlet 13 for the heated supply air. That remarkably simplifies the insulation works, reduces the material cost and provides an inexpensive rotary-type heat exchanger.

The outer periphery of the rotor 2 is provided with a ring 2*a* made of regular or stainless steel in order to reinforce the ceramic honeycomb structure therein. The ring 2*a* is cooled consequently. As compared to steel, ceramics has an extremely small coefficient of thermal expansion, the ring 2*a* will expand remarkably if the rotor 2 becomes high temperature as a whole. But the ring 2*a* is simultaneously cooled as explained above, the ring 2*a* is almost free of such influence and will not be dissembled from the rotor 2.

As the other air used for cooling is mixed in the supply air SA, the efficiency will be slightly reduced. The efficiency, however, can be improved by increasing the diameter of the rotor 2. The cost increase caused by incremented diameter of the rotor 2 to improve the efficiency is smaller than the cost reduction which is attained by simplifying the insulation and lowering the cost of the parts.

The above mentioned effect can be achieved even if the positional relation of the opening 12 and the outlet 13 is reversed. Furthermore, in the case of the rotor 2 being a ceramic made honeycomb structure, the temperature rise of the shaft 3, bearing 4, 5, the ring 2*a* for reinforcing the rotor 2 and the casing 1 is very reduced, because the heat transmission in the rotor 2 along the radial direction by the hot gas is very small as well as the central part and the peripheral part of the rotor 2 are cooled down by the cool gas.

The present invention has been described for a rotary-type heat exchanger for high temperature in the foregoing, but it can naturally be applied also to a rotary-type heat exchanger for fairly low temperatures.

What is claimed is:

1. A rotary type heat exchanger comprising:

a casing having on one face thereof an inlet for high temperature gas and an outlet for heated air, and on an opposed face thereof a corresponding exhaust gas outlet for cooled gas and an inlet for cooling air, respectively, said inlets and outlets being diametrically disposed with respect to each other;

a rotor disposed in said casing on a shaft about a central axis parallel to said inlets and outlets and provided with axial heat exchanger passages for transmitting gas therethrough;

sealing means to direct high temperature gas from said high temperature inlet to said corresponding outlet for cooled gas through said axial passages, while excluding those passages adjacent said rotor shaft and the outer periphery of said rotor;

means to direct cooling air from said inlet for same about the outer periphery of said rotor and through said excluded axial passages in the outer periphery of said rotor and through said excluded axial passages adjacent said rotor shaft and thence to said outlet for heated air;

whereby high temperature gas is cooled and the inside of said casing and areas close to said shaft and to the outer periphery of said rotor are cooled.

2. A heat exchanger as claimed in claim 1, wherein said high temperature gas inlet is provided with a heat resistant material, sealing means are provided about said exhaust gas outlet for cooled gas, and said heated air outlet is provided with a heat resistant material.

3. A heat exchanger as claimed in claim 1, wherein a ring having a diameter substantially equal to the outer diameter of said rotor is coaxially disposed with respect thereto on the inner side of said casing provided with said inlet for high temperature gas, and sealing means is provided between the top of said ring and said rotor to minimize leakage of gas.

4. The heat exchanger as claimed in claim 1, wherein the heat exchange portions of said rotor ~~are~~ composed of a high temperature-resistant ceramic material and said axial heat exchange passages are in the form of a honeycomb structure.

* * * * *